US011434127B2

(12) United States Patent
Booher

(10) Patent No.: US 11,434,127 B2
(45) Date of Patent: Sep. 6, 2022

(54) CUP PUSH TRIP LEVER ADAPTER

(71) Applicant: BUNN-O-MATIC CORPORATION, Springfield, IL (US)

(72) Inventor: Adam Booher, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 17/328,977

(22) Filed: May 24, 2021

(65) Prior Publication Data

US 2021/0362994 A1 Nov. 25, 2021

Related U.S. Application Data

(60) Provisional application No. 63/029,547, filed on May 24, 2020.

(51) Int. Cl.
*B67D 3/00* (2006.01)

(52) U.S. Cl.
CPC ..... *B67D 3/0025* (2013.01)

(58) Field of Classification Search
CPC .... B67D 3/0025; B67D 3/0054; B67D 7/005; B67D 1/00; B67D 2001/0089
USPC ..... 141/351, 362
See application file for complete search history.

(56) References Cited

U.S. PATENT DOCUMENTS 939,069 A * 11/1909 McLean ..... F16K 31/58 251/156
2,066,169 A * 12/1936 Zwosta ..... B67D 1/124 141/196
2,610,019 A * 9/1952 Beall ..... F16K 21/16 177/117
3,904,174 A 9/1975 Giese
4,111,243 A * 9/1978 Fetterman ..... B67D 1/1234 141/102
4,138,092 A * 2/1979 Apellaniz ..... B67D 1/1438 251/325
4,210,262 A * 7/1980 Donaldson ..... B67D 3/02 141/362
4,252,160 A * 2/1981 Numbers ..... B67D 1/1405 141/362

(Continued)

OTHER PUBLICATIONS

Cal-Mil, "All-In-One Hands-Free Spigot," accessed via the Internet at: https://calmil.com/products/browse-categories/health-and-safety/all-in-one-hands-free-spigot.html, (believed to be publicly available at least by May 24, 2020).

(Continued)

*Primary Examiner* — Timothy L Maust
(74) *Attorney, Agent, or Firm* — Barnes & Thornburg LLP

(57) ABSTRACT

An adapter and a method of operation of the adapter. The adapter is configured for use with a faucet of a beverage dispenser to facilitate reduced touching of the dispenser or touchless use of the faucet. The adaptor includes a body having a faucet handle engaging portion, a fulcrum portion, at least one extending portion, and a cup engaging portion. A nozzle clearance area is defined generally between the cup engaging portion and the fulcrum portion. The method of operation provides attachment of the adaptor to the faucet without the need for tools, fasteners, adhesives, or the like. The method of fabrication allows for the adaptor to be fabricated from a generally planar piece of material and manufactured to provide the structure as defined.

5 Claims, 11 Drawing Sheets

(56) References Cited

U.S. PATENT DOCUMENTS

| | | | | |
|---|---|---|---|---|
| 4,905,875 | A | 3/1990 | Straiten | |
| 4,938,386 | A | 7/1990 | Roethel et al. | |
| 6,230,769 | B1 * | 5/2001 | O'Brien | B67D 1/06 137/378 |
| D506,634 | S | 6/2005 | Maddux | |
| D506,889 | S | 7/2005 | McDaniel et al. | |
| 6,988,641 | B2 | 1/2006 | Jones et al. | |
| 7,753,231 | B2 * | 7/2010 | Giles | B67D 1/0888 222/14 |
| 8,196,779 | B1 | 6/2012 | Czarnecki | |
| 9,376,304 | B2 * | 6/2016 | Trulaske | B67D 1/1272 |

OTHER PUBLICATIONS

Cal-Mil, "Commercial Style Spigot Adapter," accessed via the Internet at: https://calmil.com/products/browse-categories/health-and-safety/commercial-style-spigot-adapter.html, (believed to be publicly available at least by May 24, 2020).

Cal-Mil, "Retro-Fit Hands-Free Spigot Adapter," accessed via the Internet at: https://calmil.com/products/browse-categories/health-and-safety/retro-fit-hands-free-spigot-adapter.html, (believed to be publicly available at least by May 24, 2020).

Hamilton Beach, "Coffee Makers," accessed via the Internet at: https://hamiltonbeach.com/coffee-makers?filter=coffee+urns&search=undefined, (The actual publication date of this reference is not known by Applicant. The date when the Web page was accessed is Oct. 29, 2020 on which the document appears to have been available as a publication. (MPEP 609.04(a))).

Hotel Restaurant Supply, "Hands Free Spigots" accessed via the Internet at: https://www.hotelrestaurantsupply.com/mm5/merchant.mvc?Screen=SEARCH&q=spigot+adapter, (The actual publication date of this reference is not known by Applicant. The date when the Web page was accessed is at least as early as Jul. 15, 2021 on which date the document appears to have been available as a publication. (MPEP 609.04(a))).

Hubert, "Stainless Steel Hands Free Spigot Adapter," accessed via the Internet at: https://www.hubert.com/product/15122/HUBERT--Stainless-Steel-Hands-Free-Spigot-Adapter---7-7-10-L-x-2-1-4-W-x-1-2-D?searchTerm=coffee, (The actual publication date of this reference is not known by Applicant. The date when the Web page was accessed is at least as early as Jul. 15, 2021 on which date the document appears to have been available as a ublication. (MPEP 609.04(a))).

Marco Beverage Systems, "Hands-Free Tap Adapter," accessed via the Internet at: https://marcobeveragesystems.com/products/hands-free-tap-adapter/ (The actual publication date of this reference is not known by Applicant. The document may have been available as a publication Apr. 13, 2021 based on the "date premiered" on the linked YouTube video. (MPEP 609.04(a))).

Newco Enterprises, Inc., "Newtap—Designed for Glass and Thermal Brewers," accessed via the Internet at: https://www.newcocoffee.com/wp-content/uploads/2020/11/Newtap_SpecSheet_11.6.2020.pdf (The actual publication date of this reference is not known by Applicant. The document may have been available as a publication Nov. 6, 2020 based on the date that appears to have been embedded in the link. (MPEP 609.04(a))).

Newco Enterprises, Inc., "No Touch Handle," accessed via the Internet at: https://www.newcocoffee.com/wp-content/uploads/2020/08/LARGE_no_touch_handle_.pdf, (The actual publication date of this reference is not known by Applicant. The document may have been available as a publication Aug. 2020 based on the date that appears to have been embedded in the link. (MPEP 609.04(a))).

Service Ideas, "Hands-Free Spigots, Touchless Dispensing Option," accessed via the Internet at: https://www.serviceideas.com/hands-free-spigs.html, (The actual publication date of this reference is not known by Applicant. The date when the Web page was accessed is at least as early as Oct. 29, 2020 on which date the document appears to have been available as a publication. (MPEP 609.04(a))).

Wilber Curtis, "New Touchless Adapters Convert Existing Curtis Dispensers to a Touchless Program," accessed via the Internet at: https://www.wilburcurtis.com/post/new-touchless-adapters-convert-existing-curtis-dispensers-touchless-program (Aug. 13, 2020).

Tomlinson, "No Drip® Division," accessed via the Internet at: https://www.daslos-studios.com/ClientMedia/6ee55b94-25b7-4735-a9d3-0e21daafef20/0124b9b6-65ce-445e-a293-d79ed7c0e41b.pdf, (The actual publication date of this reference is not known by Applicant. The date when the Web page was accessed is at least as early as Oct. 29, 2020 on which date the document appears to have been available as a publication. (MPEP 609.04(a))).

TableCraft, "Universal Touchless Faucet," accessed via the Internet at: https://www.tablecraft.com/Universal-Touchless-Faucet (The actual publication date of this reference is not known by Applicant. The date when the Web page was accessed is at least as early as Oct. 29, 2020 on which date the document appears to have been available as a publication (MPEP 609.04(a))).

TableCraft, Rectangular Duel Beverage Dispenser, accessed via the Internet at: https://www.tablecraft.com/Rectangular-Duel-Beverage-Dispenser (The actual publication date of this reference is not known by Applicant. The date when the Web page was accessed is at least as early as Oct. 29, 2020 on which date the document appears to have been available as a publication (MPEP 609.04(a))).

Fetco, "L4D-20TLA," accessed via the Internet at: https://www.fetco.com/pl,product,155.html (The actual publication date of this reference is not known by Applicant. The date when the Web page was accessed is at least as early as Oct. 29, 2020 on which date the document appears to have been available as a publication (MPEP 609.04(a))).

* cited by examiner

CUP PUSH TRIP LEVER ADAPTER

CROSS REFERENCE TO RELATED APPLICATIONS

This application claims the benefit of priority under 35 U.S.C. § 119(e) to U.S. Provisional Patent Application No. 63/029,547, filed May 24, 2020. The disclosure set forth in the referenced application is incorporated herein by reference in its entirety.

BACKGROUND

A variety of beverage dispensing devices have been developed for controllably dispensing beverages. Typically, the beverage dispensing device has a reservoir portion which retains a volume of prepared beverage. Such prepared beverages can be in the form of heated, cooled, or ambient. A device such as a dispensing faucet or spigot is provided on the dispenser so that a user can controllably dispense a volume of beverage from the dispenser. This allows a beverage provider such as a restaurant, convenient store, banquet facility or other location to provide a volume of prepared beverage available for customer use and to allow self-serve or customer dispensing of the beverage from the container in a controlled manner. Such dispensers have become virtually ubiquitous in the restaurant environment either on the customer side or crew side of the kitchen.

While such dispensers can be provided with a variety of faucet styles, there are some generally common components of such a faucet. The faucet attaches to the reservoir of the dispenser by means of a hollow shank that connects to the side wall or bottom wall of the reservoir. The cavity formed by the walls of the reservoir communicate with the hollow portion of the shank to allow beverage to flow from the reservoir into the shank. The faucet also includes a valve assembly in a nozzle body to control or stop the flow of beverage out of the nozzle. The valve portion is connected to a valve operating assembly including a handle that allows the user to grip the handle, move the handle, and operate the valve.

As an example, a typical reservoir allows beverage to be available to a customer. The customer approaches the dispenser with a cup, holds the cup under the faucet, and operates the faucet by gripping the handle. Customers have become used to the hand eye coordination to grip the handle and controllably move the handle to a degree that allows controlled dispensing with little or no splashing into the cup or overflow from the cup. Typically, users position the cup by gripping the outside wall of the cup and positioning a mouth of the cup underneath the outlet of the nozzle. This typically aligns the nozzle within the area defined by the rim of the cup or mouth. As the customer watches the beverage flow from the nozzle into the cup they may reduce the flow by manipulating the handle to facilitate some closure of the valve as they approach the level of beverage in the cup that they wish to dispense. Once the customer has dispensed the desired amount into the cup they release the handle and it returns to the "home" position whereby the valve is closed. In other words, such valve assemblies are configured to provide a normal "closed" position by means of a valve system that might be in the form of a spring loaded valve either by use of an elastomeric or coil spring, as well as similar devices.

While customers are familiar with this type of operation, it can involve unintended communication of germs, dirt, other material or substances that might be carried on their hands. If a customer has substance on their hands they unintentionally may transfer that to the handle portion of the dispensing nozzle. In addition, the customer would not want to touch the cup rim to the nozzle. Either the current customer may have already sipped out of the cup and thus transferred anything that is on their lips or on their mouth to the cup rim or a preceding customer may have done this. As such, it would be desirable to provide a generally touchless beverage dispensing experience by means of an adapter that communicates with and functions with a faucet to reduce or eliminate the need to directly touch the surfaces of the faucet to operate the faucet and dispense beverage from the reservoir. Such a touchless adapter would help to reduce or eliminate the potential for transfer of substances from customers to the faucet, the beverage dispensing device, and their components and surfaces.

As an additional matter, as noted above, a variety of faucets have been used on a variety of beverage dispensers. This could be either because the beverage dispenser requires a particular type of faucet or the manufacturer seeks to have a proprietary or other stylized handle. Therefore it would be helpful to provide an adapter that can be used to operate the faucet in a touchless manner and that can be used on a variety of dispensing faucets.

It would be desirable to provide a device that can be attached, is attachable, and/or is removably attached to a dispensing faucet on a beverage dispenser to eliminate the need for a customer to physically engage or otherwise contact the handle of the faucet. In addition, it would be useful to also configure such an adapter so as to prevent contact between the customer and any other dispensing components associated with the nozzle or the device. In addition, it would be desirable to provide an adapter that can be attached to a faucet that also prevents contact with the rim of the cup. Such a adapter in such a configuration would be useful to reduce the contact between users and the faucet assembly and reduce the transfer of materials from the users' hands, from the rim of the cup, and any other surfaces to the dispenser.

A variety of dispensing faucets have been developed. An example of such a dispensing faucet can be found in U.S. Pat. No. 3,904,174 (the "Giese Patent"). Such a dispensing faucet has been described above, generally with regard to a type of dispensing faucet. The Giese Patent shows a faucet assembly that includes a nozzle body, a shank, a valve assembly, and a handle for operating the valve assembly. The handle in the Giese Patent is generally configured in such a manner that there is a vertical upstanding portion that can be gripped by the user. While not clearly shown, this type of handle is the type that has been produced by Tomlinson Industries (The Meyer Company) which includes a forked portion with a cross member defining an aperture within the handle. It is believed that this type of handle assembly is configured and functions to allow a user to grip the handle for operation.

Another example of a dispensing apparatus is a cup trip assembly such as the one shown in U.S. Pat. No. 4,938,386 (the "Roethel Patent"). Such a cup trip assembly includes a pivot cross member, downward extending arms, and a cup engaging portion. This configuration of a cup trip assembly operates in a different manner from the device as shown in the Giese Patent. The Roethel Patent is shown as being designed for a particular dispensing device.

The aforementioned patents show different types of dispensing apparatus specifically configured for attachment to a reservoir. One of the problems that arises in the beverage dispensing industry is that a single manufacturer might have multiple types of faucet handles on their devices. As such it would be desirable to provide an adapter that can provide application to a variety of handles and faucet assemblies. While all of the faucet assemblies could be removed and completely new faucet assembly attached, this is impractical since that requires significant investment in the new faucet assemblies, as well as significant time to enter the field to make modifications to such devices. Therefore it would be desirable to provide an adapter that the provider of the beverage dispenser or other party can provide to customers and that the customer can attach to a variety of faucet assemblies to facilitate touchless use of the faucet assembly on their beverage dispenser. It would also be desirable to provide such an adapter that is configured to attachment to an existing faucet in the field and to accomplish this attachment without the need for tools, fasteners, adhesive, or other accessories.

This background information is provided for some information believed by the applicant to be of possible relevance to the present disclosure. No admission is intended, nor should such admission be inferred or construed, that any of the preceding information constitutes prior art against the present disclosure. Other aims, objects, advantages and features of the disclosure will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which:

FIGS. 10 and 12 show the adapter used to actuate the corresponding handles by pressing a cup wall against a cup engaging portion of the adapter to leverage the faucet into a position to open the valve of the faucet and dispense beverage into the cup therebelow, the configuration of the adapter being such that the cup mouth generally aligns with the outlet of the faucet nozzle to receive beverage dispensed from the faucet when the faucet is actuated to dispense beverage;

Figure 1:
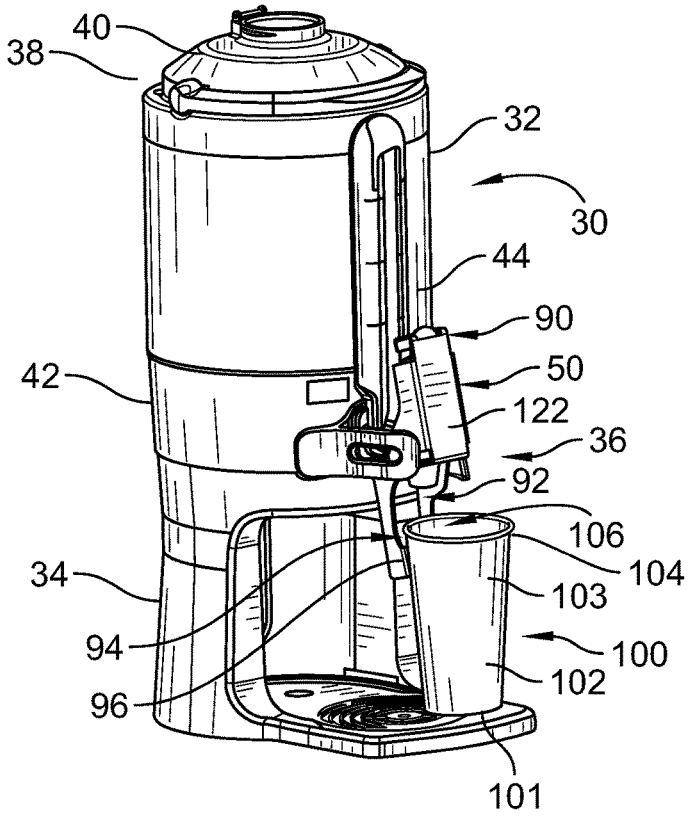
FIG. 1 shows a multiple faucet operating adapter attached to a faucet of a beverage dispensing device showing a cup positioned for actuation of the operating adapter to dispense a beverage from the dispenser by actuating a valve of a faucet without touching a handle provided on the faucet, with actuation being accomplished by pressing a surface such as a wall of the cup against a cup engagement portion of the adapter to eliminate contact by the user with the beverage device, and operation of the faucet using the adapter reducing or eliminating contact between the user and the dispenser.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

As shown in FIG. 1, shows a beverage dispensing device 30 including a reservoir 32, a base 34, and a dispensing assembly 36. The reservoir 32 includes an upper portion 38 with a lid 40 and a lower portion 42 to which the dispensing assembly 36 is attached. In this regard, such a dispensing device 30 typically operates by gravity flow out of the reservoir through controlled operation of the dispensing assembly 36. A sight glass 44 is provided on the reservoir 32 to indicate to the user dispensing beverage from the device 30 the approximate volume of beverage in the reservoir.

Figure 6:
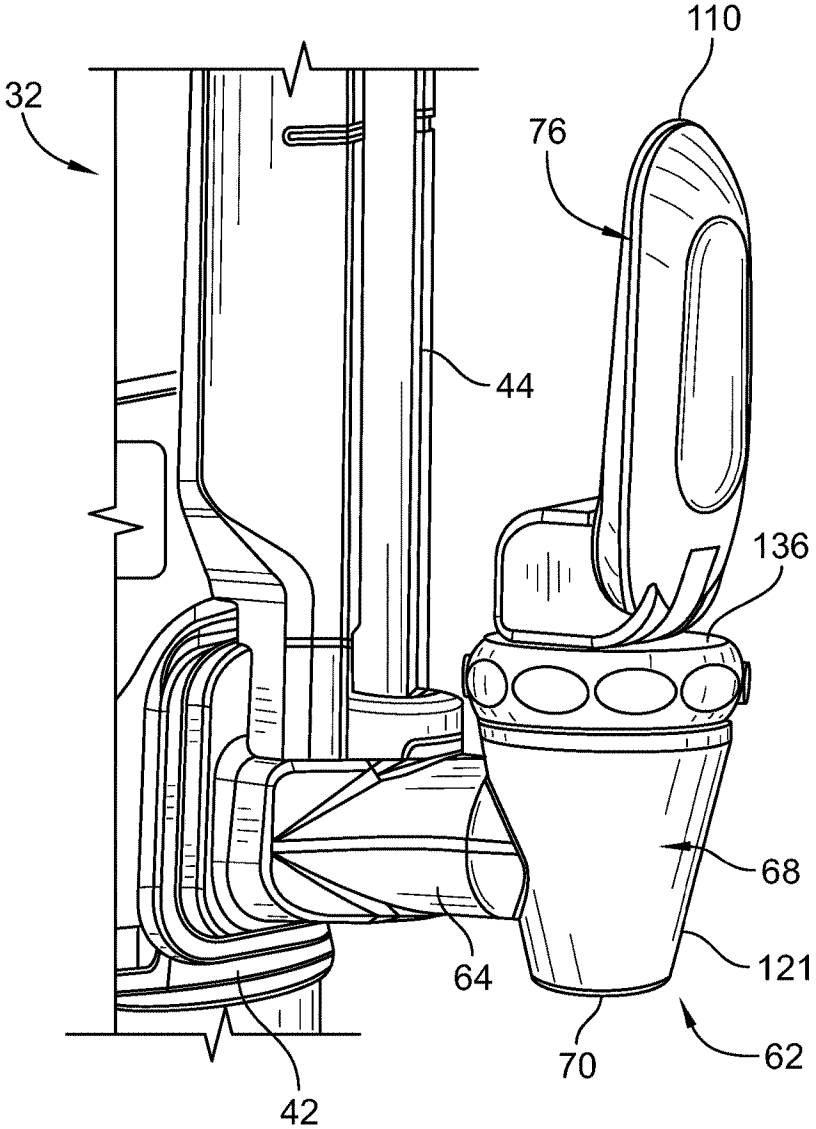
FIG. 5 and FIG. 6 show perspective views of two examples of different faucet configurations in which the faucets are generally similar but the handles used to operate the faucet are different, namely, FIG. 5 showing a forked or branched faucet handle, and FIG. 6 showing a vertically extending petal or tap-style faucet handle.
Figure 5:
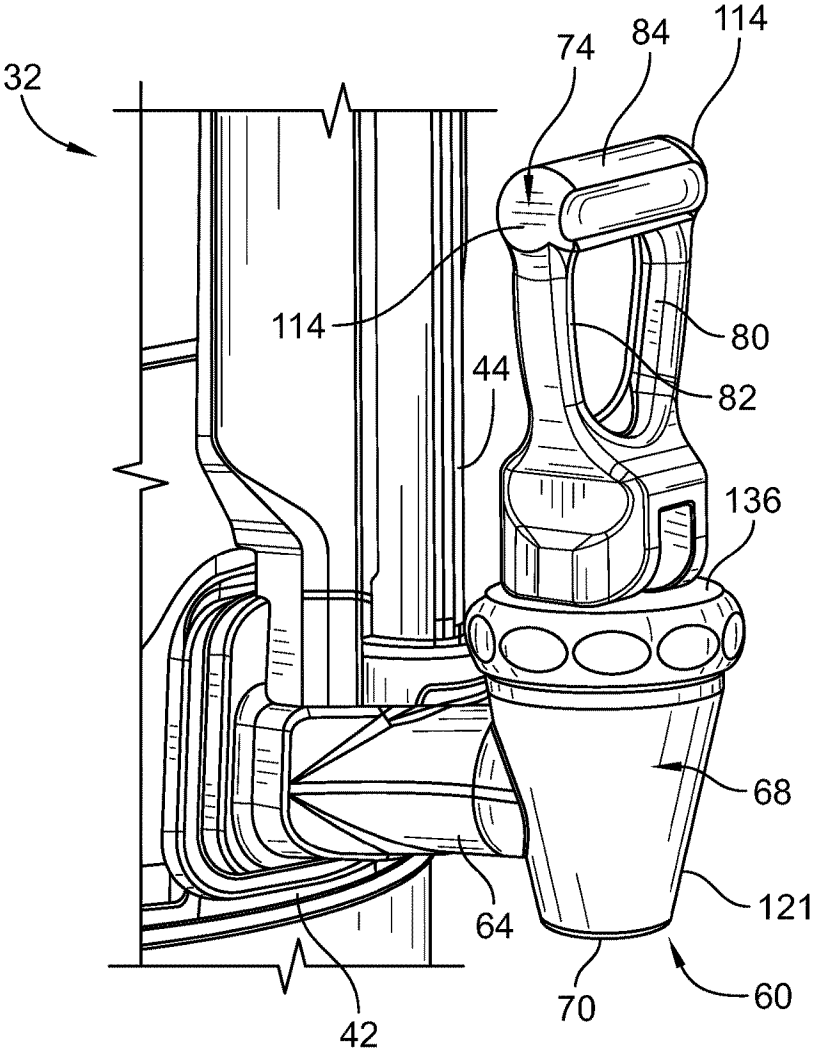
Figure 8:
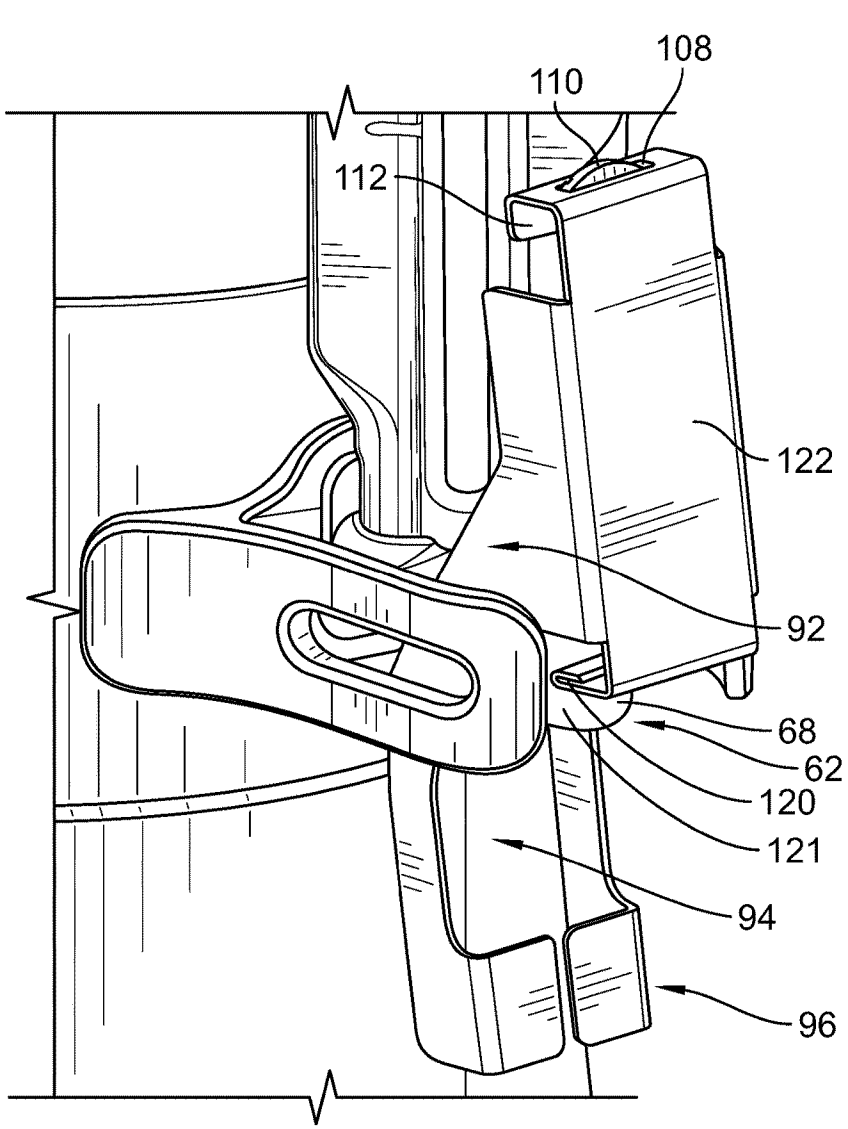
FIGS. 7 and 8 show the adapter attached to the faucet configurations of FIGS. 5 and 6, respectively, showing ear portions of the handle in FIG. 5 extending through the side openings with a crown or tip of the handle configuration in FIG. 6 extending through the top opening.
Figure 12:
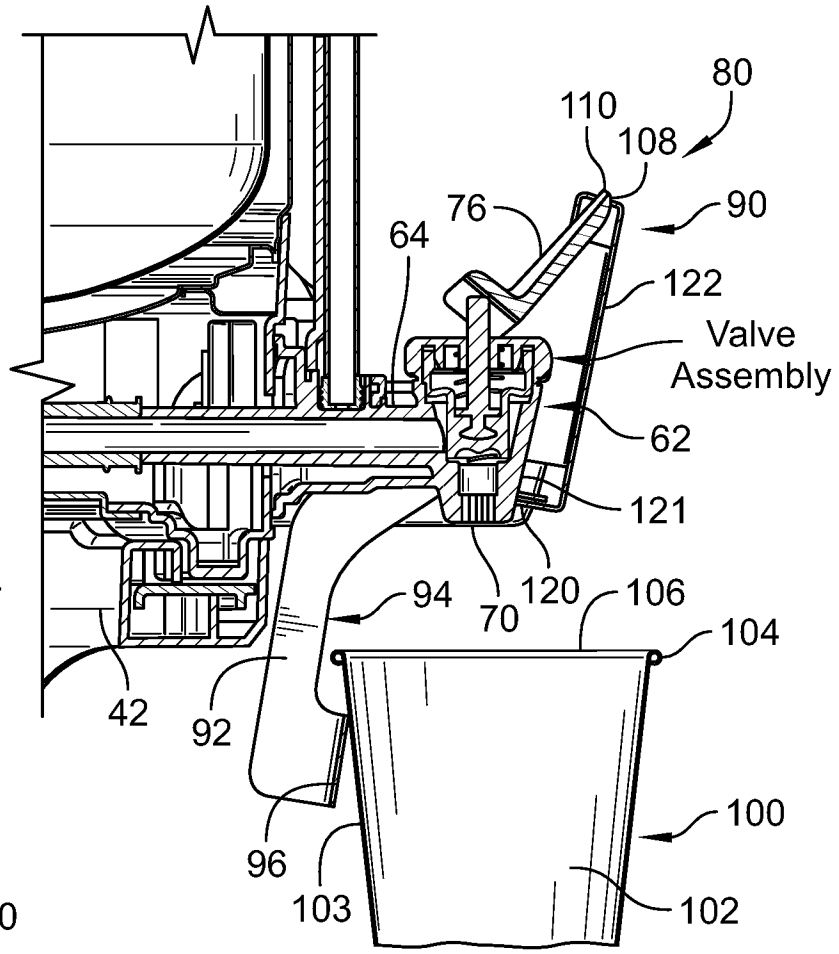
FIGS. 11 and 12 show the placement of a cup next to the unactuated faucet on which an adapter is attached corresponding to the handle configurations as shown in FIGS. 5, and 6, respectively.
Figure 11:
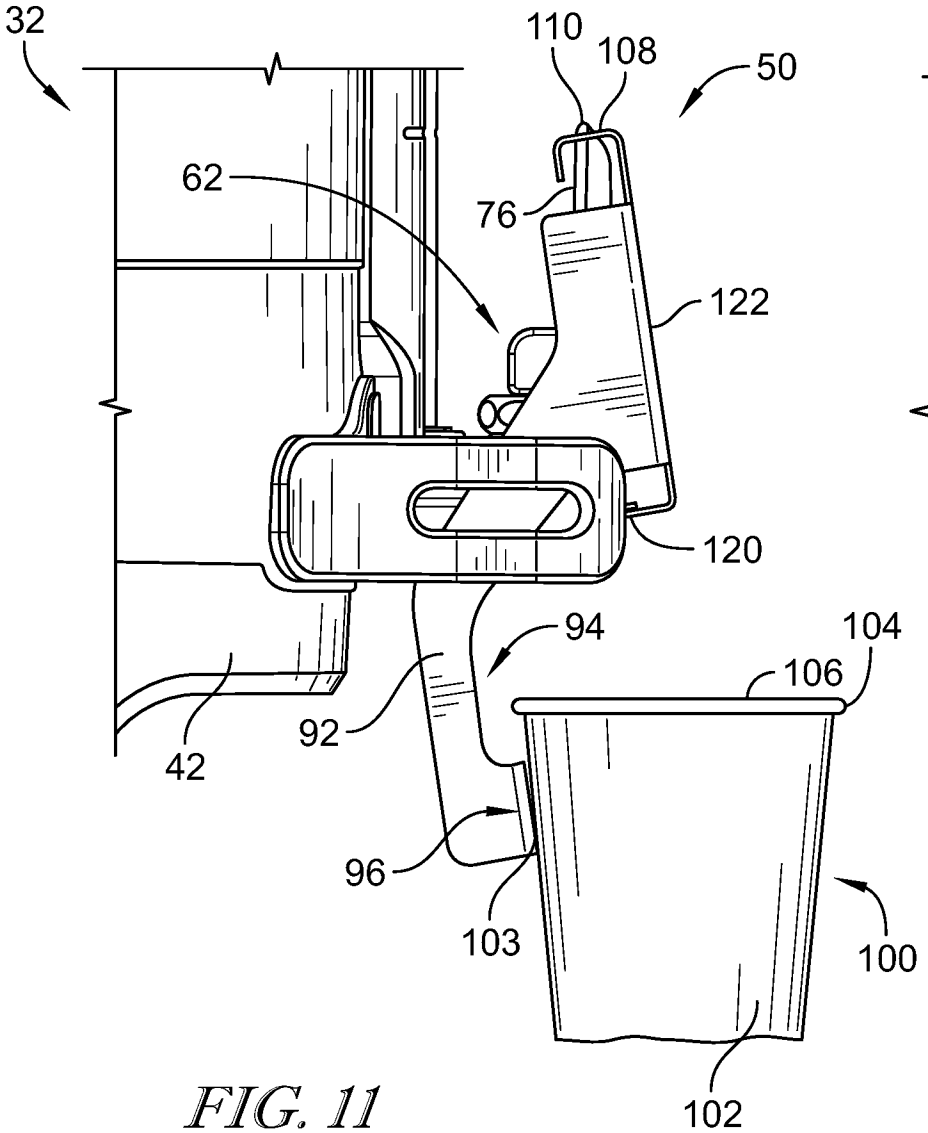
Figure 13:
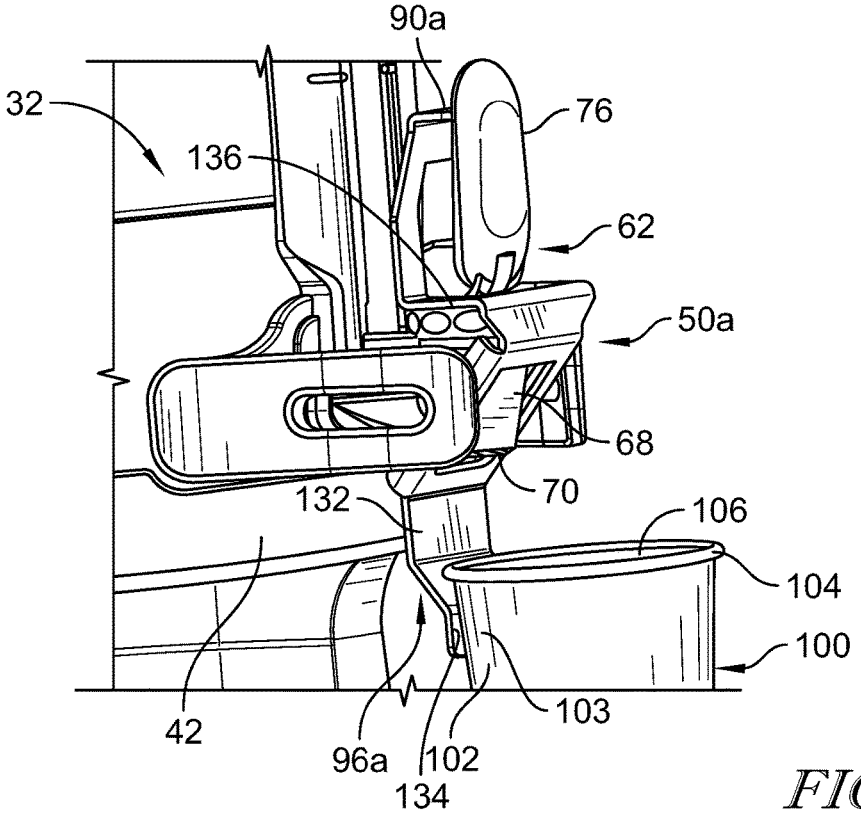
FIGS. 13-17 show a configuration of an adapter for use with a tap-style handle including a corresponding handle engaging portion, stiffening portion, nozzle clearance area, and cup engaging portion, with FIG. 13 showing a perspective view of the adapter attached to a faucet on a dispenser such as that as shown in FIG. 1, FIGS. 14 and 15 showing front and rear perspective views of the adapter, respectively, and FIGS. 16 and 17 showing side elevational views of the adapter, 16 with the adapter attached to the faucet, and 17 showing it removed from the faucet.
Figure 14:
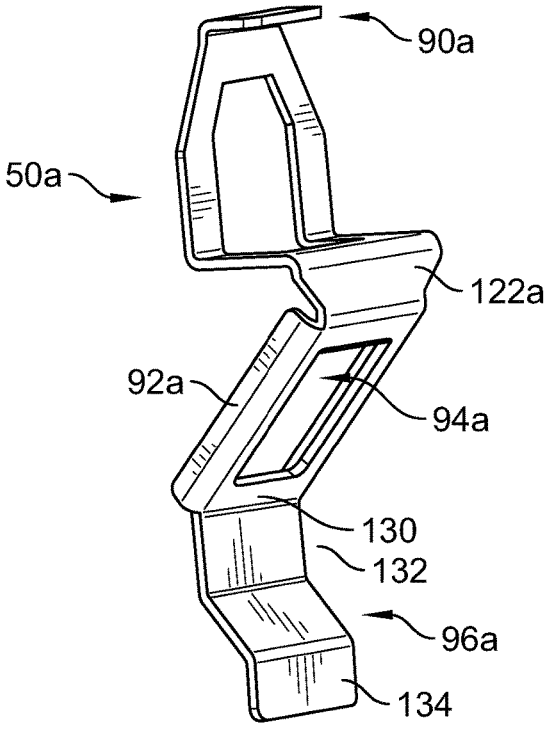
Figure 15:
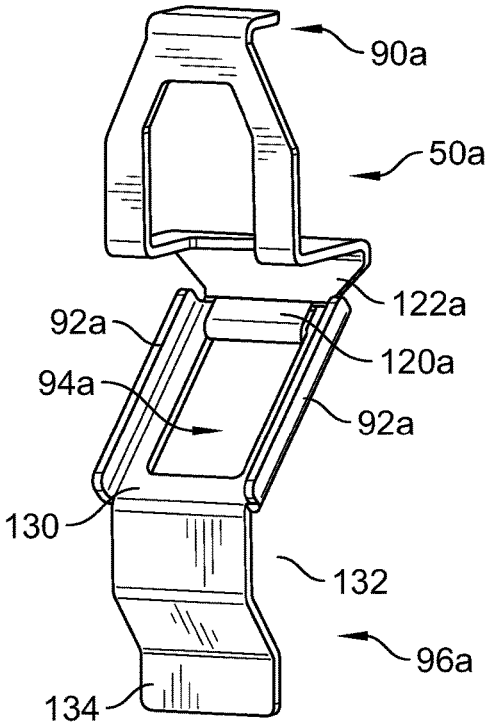
Figure 17:
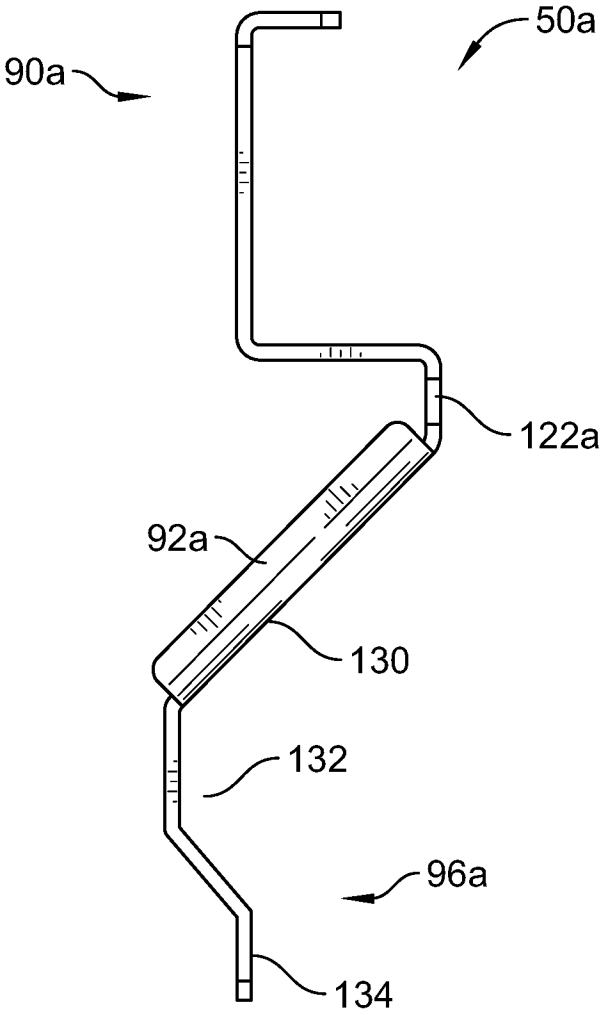
Figure 16:
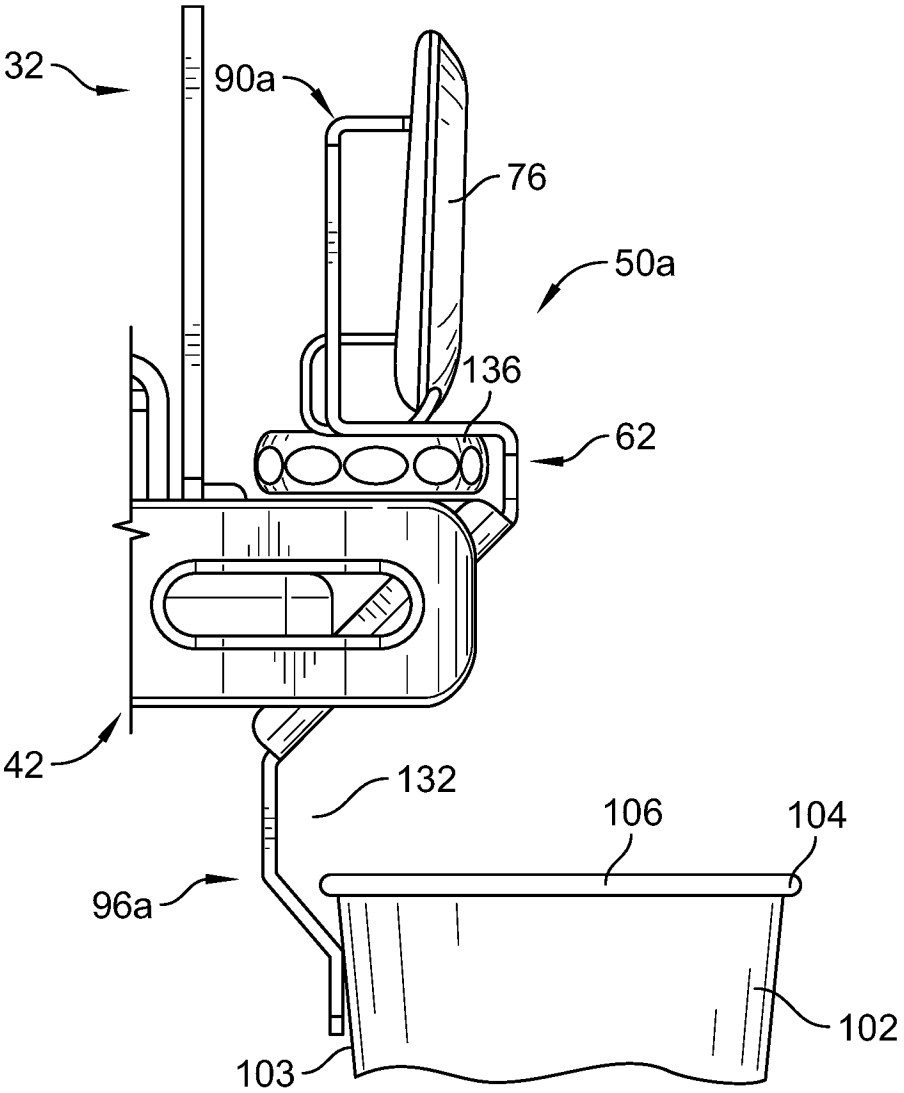
Figure 20:
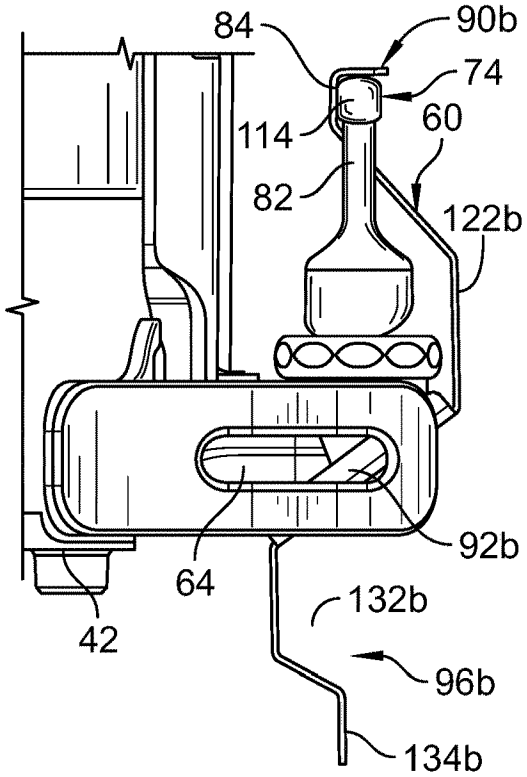
FIGS. 18-22 show an additional configuration of the adapter including a handle engaging portion, an stiffening portion, a nozzle clearance area, and a cup engaging portion configured for attachment to a handle assembly such as that shown in FIG. 5 with FIG. 18 showing a rear perspective view of the adapter, FIGS. 19 and 20 showing the adapter attached to a handle on a faucet, and FIGS. 21 and 22 showing the adapter in a closed faucet position (FIG. 21) and adapter used to operate the handle and the faucet valve to an open position.
Figure 19:
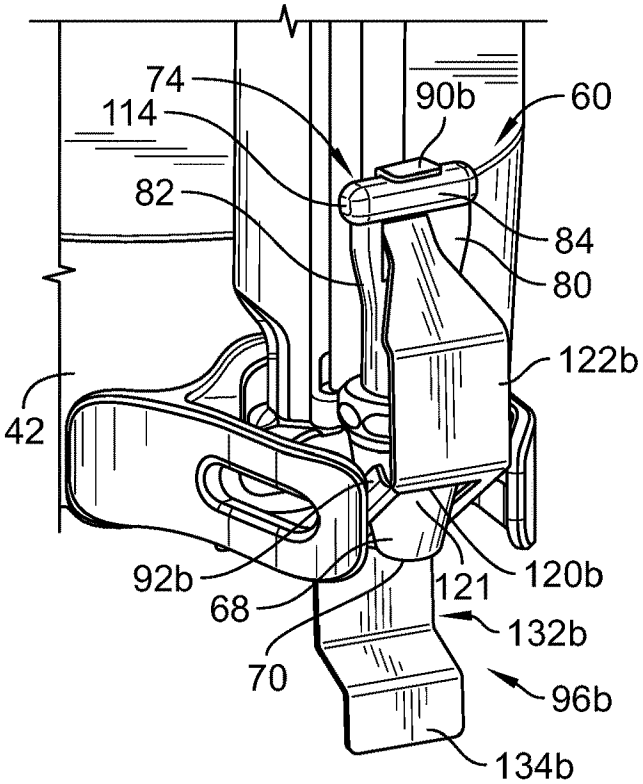
Figure 18:
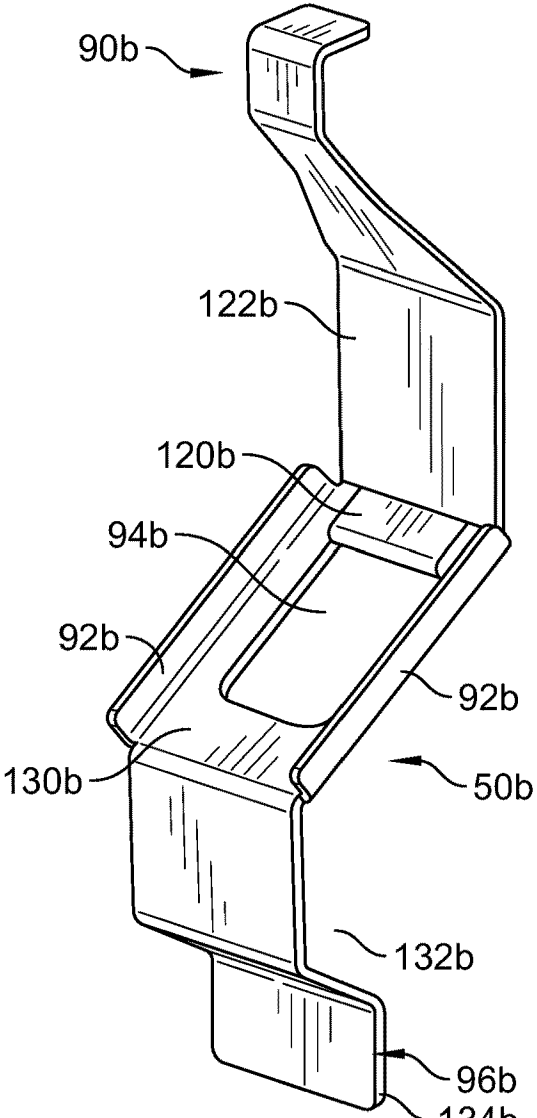
Figure 22:
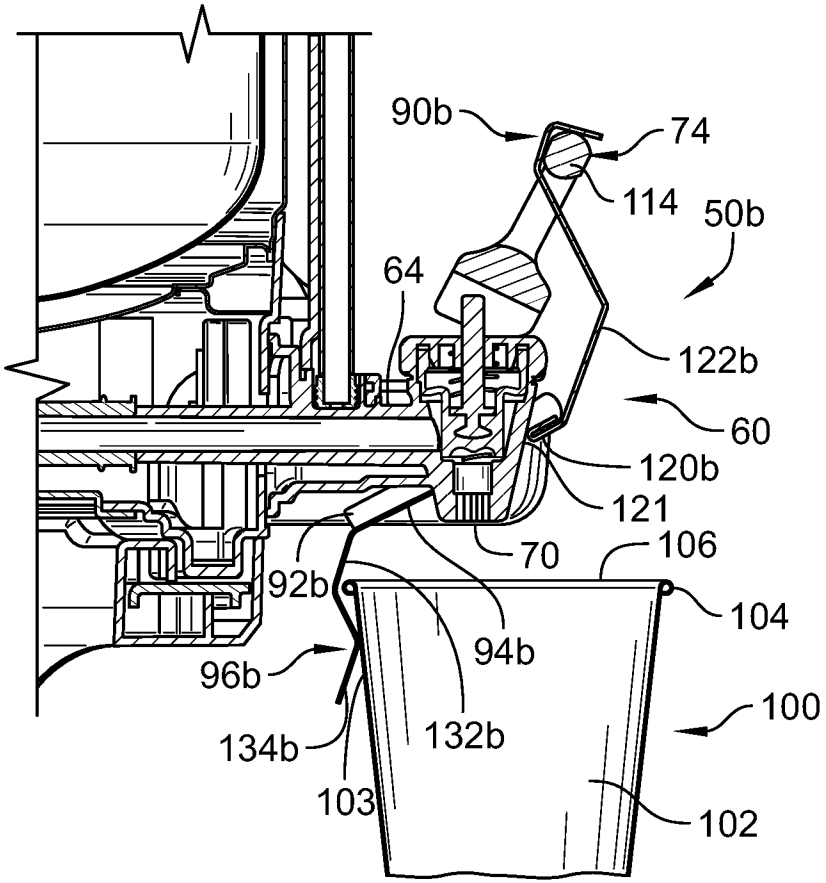
Figure 21:
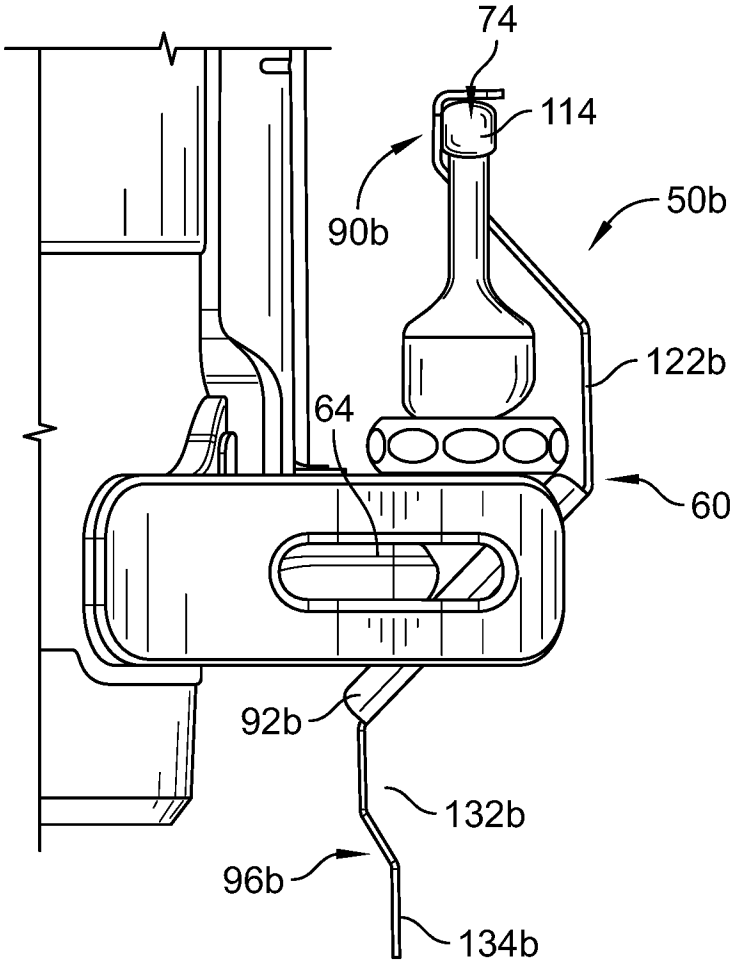

As shown in FIG. 1, an adapter 50 is attached to the dispensing assembly 36. The adapter 50 as shown in more detail in FIGS. 7-12 including the operation of the adapter 50 with a faucet assembly. The faucet assembly as used in FIG. 1 is part of the dispensing assembly 36 and might take the form of a faucet assembly 60 such as the one showing in FIG. 5 or the faucet assembly 62 as shown in FIG. 6. Each of the faucet assemblies 60, 62 generally includes a shank 64 attached to the lower portion 42 of the reservoir 32. As previously indicated, gravity flow of beverage in the reservoir causes beverage to flow through a hollow portion of the shank 64 and into a nozzle portion 68. The nozzle includes an outlet 70 through which beverage can flow. Although not shown in detail in FIGS. 5 and 6, the nozzle houses a valve assembly of generally known construction which controls the flow from the shank 64 to the outlet 70. In the position as shown in FIGS. 5 and 6, the valve is in the closed position with a handle 74, 76 of the respective assemblies positioned in the up position. Each handle 74, 76 is attached to a controllable portion of the valve to displace the valve when the handle is moved. In this regard, the up position is the valve closed configuration. When the valve is actuated (see FIGS. 10 and 12) the valve is opened in relation to the movement of the handle and beverage can flow through the shank and out through the nozzle 70. The faucet valves are spring loaded by a spring or elastomeric structure of known construction, or otherwise biased to a normally closed position. Operation of the adapter on the handle overcomes the force maintaining the normally closed valve position and opens the valve of the faucet to dispense through the valve.

As can be seen in FIGS. 5 and 6, the handles have different configurations. These are just two examples of different handle configurations. However, one beverage dispenser manufacturer or vendor may have multiple style handles in addition to the two as shown in FIGS. 5 and 6. In addition, a variety of beverage dispensing device 30 manufacturers might provide an even wider variety of handle configurations. As such, it is important to provide an adapter 50 that can accommodate a variety of handle configurations. As shown in FIG. 5, the handle 74 includes a forked or branched configuration including two arms 80, 82 and a cross member 84. These structures provide leverage to allow a user to grip the structures and operate the handle to displace the valve. Similarly, the handle of the configuration in FIG. 6 is more of a tap-style handle having a generally single vertical member which can gripped by the user.

Figure 7:
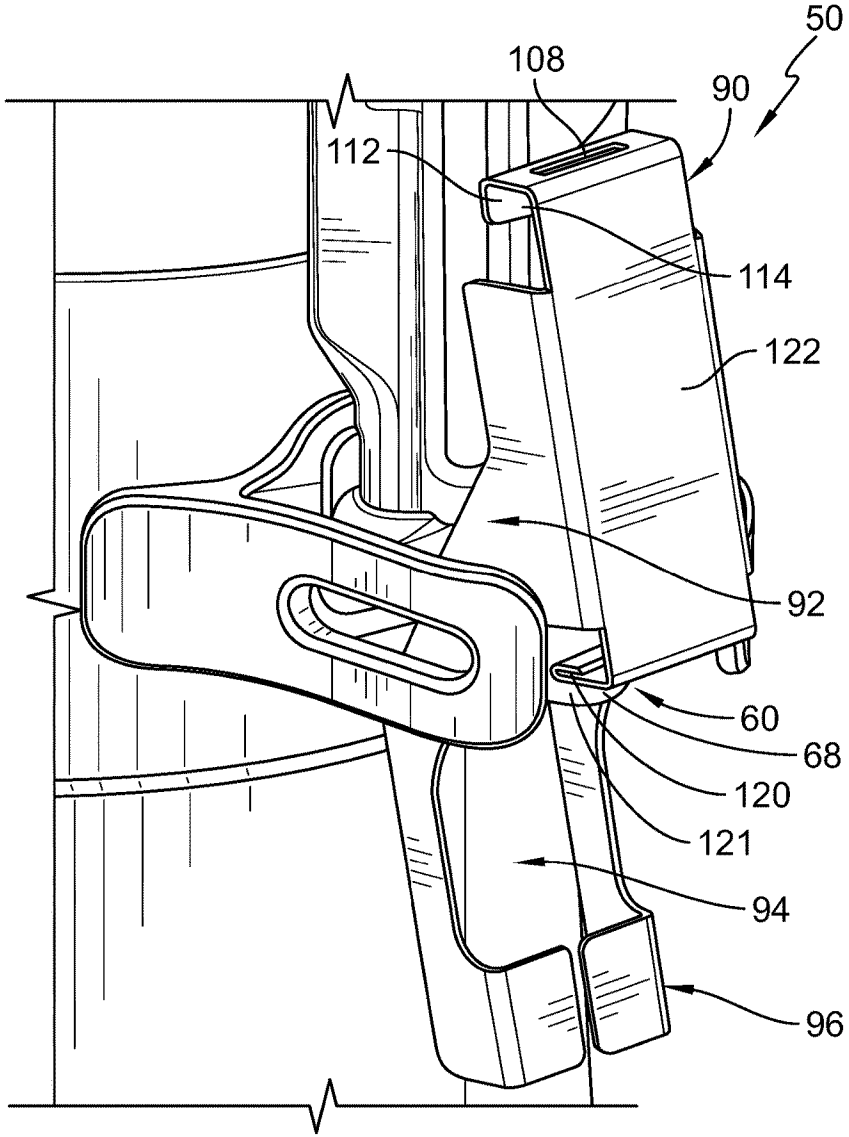
Figure 10:
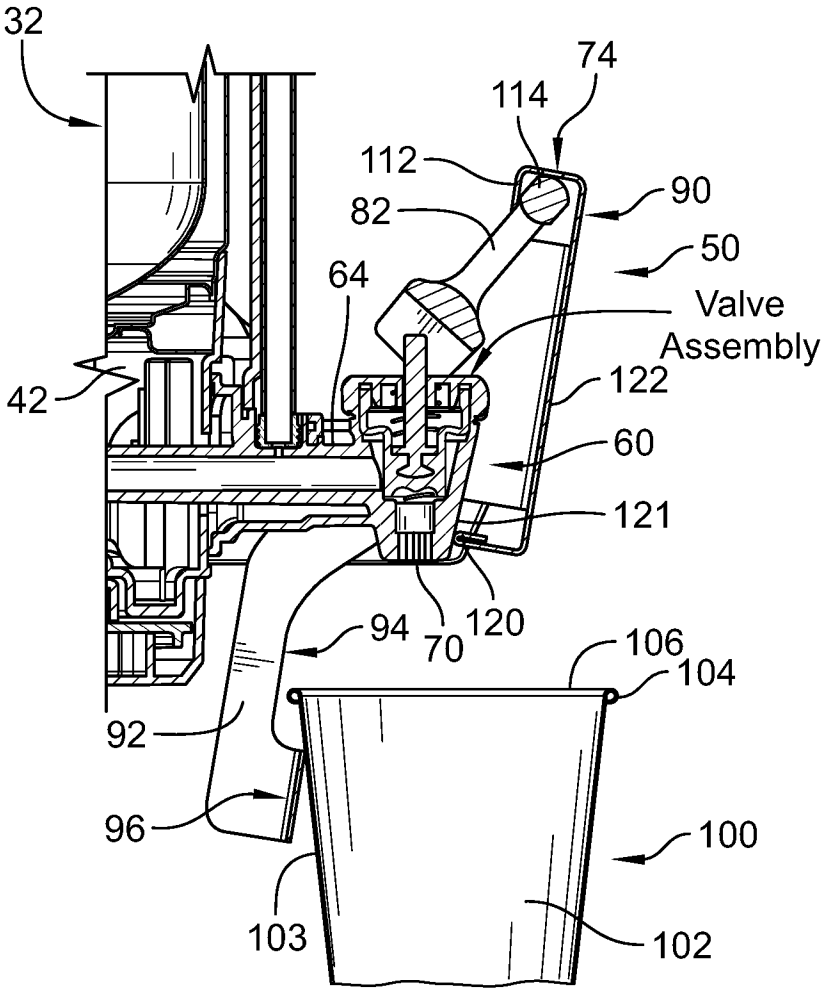
FIGS. 9 and 10, and separately
Figure 9:
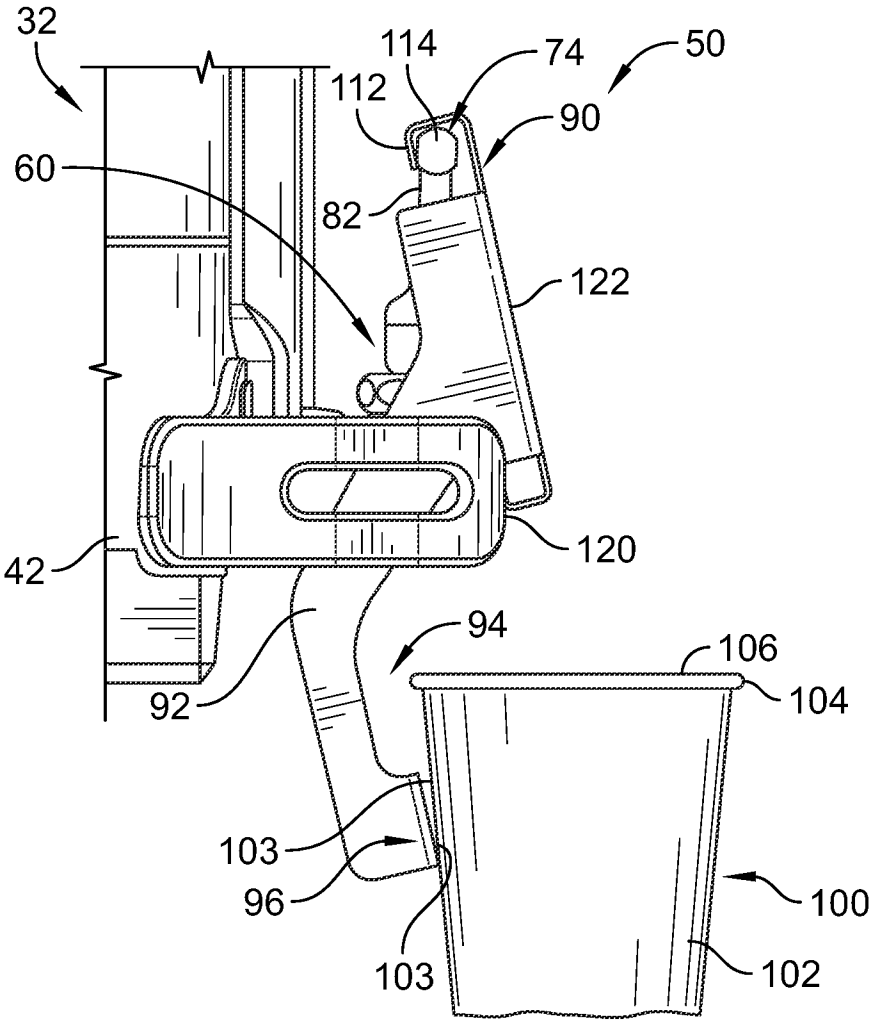

The forked-style handle 74 is shown in combination with the adapter 50 in FIGS. 7, 9 and 10. The tap-style handle 76 shown in FIG. 6 is also shown in combination with the adapter 50 in FIGS. 8, 11, and 12. As can be seen in these figures, the adapter 50 has structures that function to operate each of the valves in the same manner regardless of the handle configuration. As such, this type of adapter 50 provides a somewhat universal solution to the problem of providing an adapter 50 for use with different handles.

The adapter allows the operation of the faucet assemblies 60, 62 without touching the handle 74, 76, the nozzle body 68, nor the nozzle outlet 70. The adapter 50 in FIGS. 2-4 and 7-12, as well as the other configurations herein (FIGS. 13-17, FIGS. 18-22, and FIGS. 23-25), includes a handle engaging portion 90, stiffening portions 92, a nozzle clearance area 94, and a cup engaging portion 96. This allows the adapter 50 to be attached to a faucet 60, 62 of different configurations and operate the faucet by pressing a cup 100 against the cup engaging portion 96 to leverage the handle, controllably open the valve assembly, and operate the faucet. As a result of this configuration and this operation the only part of the dispensing process using the adapter 50 contacted by the user is the cup 100. In this regard, it is further noted that the cup 100 includes an outer wall 102 extending upwardly form a bottom 101 in a generally frusto-conical structure terminating in a rim 104 defining a mouth 106 of the cup 100. The user grips the outside surface of the cup wall 102 and presses the upper portion 103 of the cup 100 against the cup engaging portion 96. The cup engaging portion 96 is configured to extend from the stiffening portion 92 so that the rim 104 does not contact the surface of the stiffening portion 92*a* or any other surfaces of the adapter 50. This reduces or eliminates the possibility that a user operating the adapter 50 with a used cup (such as when the user has sipped form the cup by applying their lips to the rim of the cup) and does not transfer anything that was on cup rim, or the user's mouth and hence the rim 104 against any of the components of the adapter 50. This helps to improve the hygiene of this overall system and method of operation.

One of the problems with prior art configurations is that they tended to be somewhat flexible and subject to flexing, deformation, and/or breakage. Such a configuration is shown in the Roethel Patent whereby the arms terminate in an upward pivoting portion very limited structure. As a result this was subject to problems in the operation. Similarly, if this structure were merely formed of a relatively planar, bent piece of metal or other material there might not be sufficient rigidity to the structure to provide reliable, repeated, long term use. In contrast, the configurations as set forth herein provide a stiffening portion 92 that extends from the handle engaging portion 90 to the cup engaging portion 96 in a manner that provides mechanical reinforcement.

The handle engaging portion 90 includes a top opening 108 that receives and engages a tip or crown 110 of the tap-style handle 76. The handle engaging portion 90 also includes side openings 112 which receive and engage the cross member 84 which terminates in extending nubs or ears 114. In this regard, the ears 114 can extend outwardly from the side openings 112 providing an additional portion of engagement between the handle engaging portion 90 and corresponding faucet handles 74, 76.

As shown in FIGS. 7, 8, 10, and 12 a fulcrum portion 120 extends from a body portion 122 of the adapter to engage an outside portion 121 of the nozzle body 68. The fulcrum portion 120 is reinforce to provide structural strength in the operation of the faucet in the adapter 50 push operation. This results in providing additional leverage and improved pivoting travel of the handle relative to the faucet assembly. This provides a more natural operation of the faucet by pressing the cup against the cup engaging portion 96 replication the control feel of the original valve operation by controlling the handle directly.

As shown in FIGS. 9 and 10, and FIGS. 11 and 12 the adapter 50 operates the faucets 60, 62, respectively, by pressing the outside wall 102 of the cup 100 against the cup engaging portion 96 which pivots generally at the fulcrum portion 120 and leverages the handle forwardly (see FIGS. 10 and 12) to open the valve assembly and allow beverage to flow from the shank and out through the nozzle outlet 70. In other words, pushing the cup 100 against the cup engaging portion 96 towards the dispenser base 32 causes the adapter 50 to pivot against the fulcrum portion 120 contacting the nozzle body 68 thereby driving the handle engaging portion 90 forwardly or away from the dispenser 32 and actuating the valve assembly to open in proportion to the operation of the adapter 50 by the cup 100. The configuration of the adapter 50 allows a user to see around the adapter 50 sides and into the cup through the mouth 106 to monitor beverage flow into the cup. This allows the user to controllably operate the cup against the cup engaging portion 96 to increase or decrease flow of beverage into the cup. When a user has sufficient amount of beverage in the cup they can release engagement of the cup against the adapter 50 thereby returning the valve handle 74, 76 to the upright and closed position of the valve within the faucet assembly 60, 62.

FIGS. 13-17, FIGS. 18-22, FIGS. 23-25, and FIG. 266 show additional configurations of adapters, 50*a*, 50*b*, 50*c*, and 50*d* respectively. These three additional configurations all share common structures and as such we will refer to those structures using the same terminology and the same reference numbers as used in FIGS. 1-12 with the addition of an alphabetic suffix. In this regard, all three of these additional configurations include a handle engaging portion 90, stiffening portions 92, 92, a nozzle clearance area 94 and a cup engaging portion 96. Although each of these has a somewhat different configuration of the corresponding structure, these structures provide the same functions and results. In each of these configurations as well as the initial configuration in FIGS. 1-12 the adapter can be provided with the original beverage dispensing device 30 as a portion of that device, can be provided separately as a conversion, retrofit, or adapter to change a handle tripped faucet to a cup tripped faucet. In each of these configurations, the adapter changes a faucet that originally required the user to touch it, grip it, and manipulate it to dispense beverage to now operate as a faucet that can be operated without the user directly touching the structures of the faucet but only touching an outside wall of their own cup to the cup engaging portion 96 during the dispensing process. In addition, each of these configurations also provide a fulcrum point 120 that contacts a portion of the faucet and a cup engaging portion 96 that allows the cup to be engaged by the adapter and for the cup to operate the adapter without the rim of the cup contacting the structures of the adapter. In other words, only the outside wall contacts the adapter for push operation of the faucet.

The adapter in FIGS. 13-17 is designed to operate with the faucet style as shown in FIG. 6 such that an upper portion of the adapter 50*a* engages the cross member 84 of the handle 74. A fulcrum point 120*a* is provided below the engaging portion 90*a* to contact the outside surface 121 of the nozzle body. The lower portion of the nozzle, proximate to the outlet 70 extends through an area defining the nozzle clearance area 94*a*. The stiffening portions 92*a* are provided extending on either side of the clearance area 94*a* to reinforce and stiffen the material. In this regard, the stiffening portions 92*a* are upstanding flanges which extend from the body towards the cup engaging portion 96*a* and are positioned generally perpendicular to the body 130 defining the open area. Additionally, the cup engaging portion 96*a* is in the form of a "bump out" that provides a recessed area 132 to avoid contact with the cup rim 104 and the stiffening portions 96*a*. The lower portion of the cup engaging portion 96*a* is a surface 134 which is configured to contact the outside wall 102 of the cup 100. The configuration shown in FIGS. 13-17 includes the adapter 50*a* which is similar to the adapter 50*b* shown in FIGS. 18-22. The difference is that this adapter 50*a* is configured to engage an upper shoulder 136 of the faucet 62 to provide additional leverage and operating the tap-style handle 76.

The adapter 50*b* in FIGS. 18-22 is designed to operate with the faucet style 60 as shown in FIG. 5 such that an upper portion of the adapter 50*b* engages the cross member 84 of the handle 74. A fulcrum point 120*b* is provided below the engaging portion 90*b* to contact the outside surface of the nozzle body. The lower portion of the nozzle, proximate to the outlet 70 extends through an area defining the nozzle clearance area 94*b*. Stiffening portions 92*b* are provided on either side of the clearance area 94*b* to reinforce and stiffen the material. In this regard, the stiffening portions 92*b* are upstanding flanges which are positioned generally perpendicular to the body 130*b* defining the open area 94*b*. Additionally, the cup engaging portion 96*b* is in the form of a "bump out" that provides a recessed area 132*b* to avoid contact with the cup rim 104. The lower portion of the cup engaging portion is a surface 134 which is designed to contact the outside wall 102 of the cup 100. The configuration shown in FIGS. 13-17 include the adapter 50*a* which is similar to the adapter 50*b* shown in FIGS. 18-22.

Figure 25:
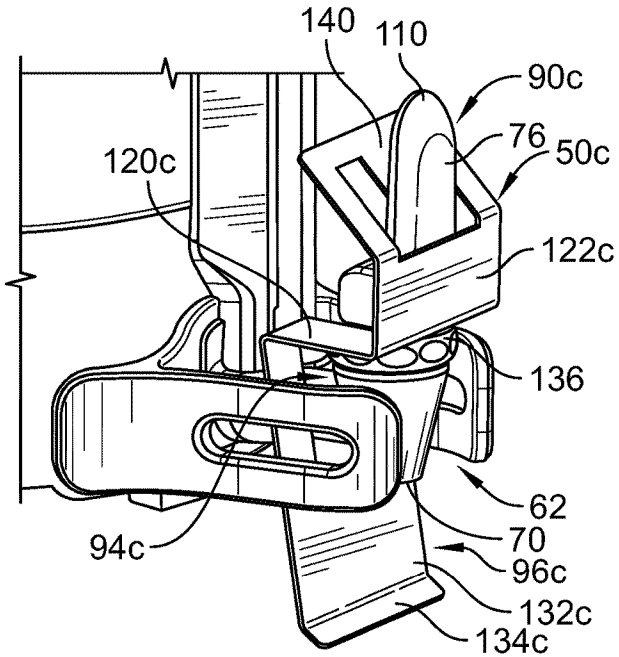
FIGS. 23-25 show a further embodiment of the adapter for use with multiple handle designs such as the two handles shown in FIGS. 5 and 6 with FIG. 23 showing a perspective view of the adapter including a handle engaging portion, stiffening portion, nozzle clearance area, and cup engaging portion, with this universal-style adapter attached to a faucet similar to that as shown in FIG. 5 (FIG. 24) and attached to a faucet handle style similar to that as shown in FIG. 6 (FIG. 25)
Figure 24:
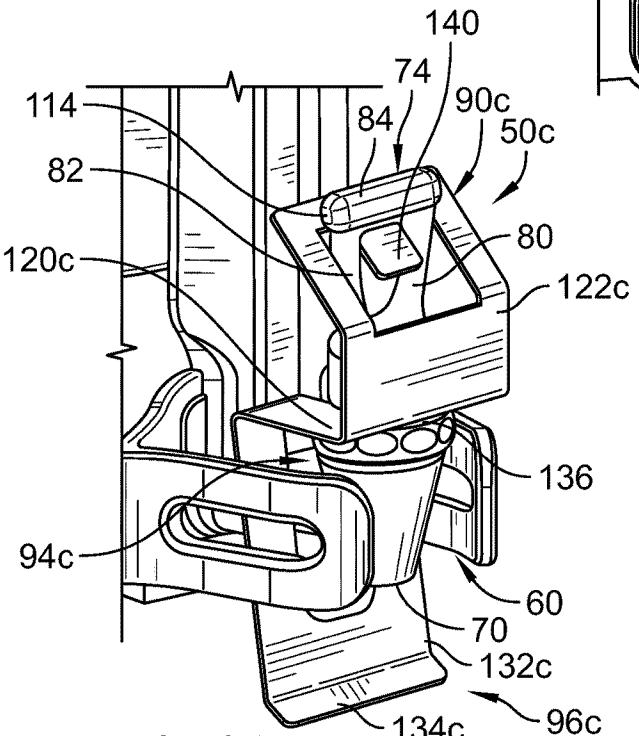
Figure 23:
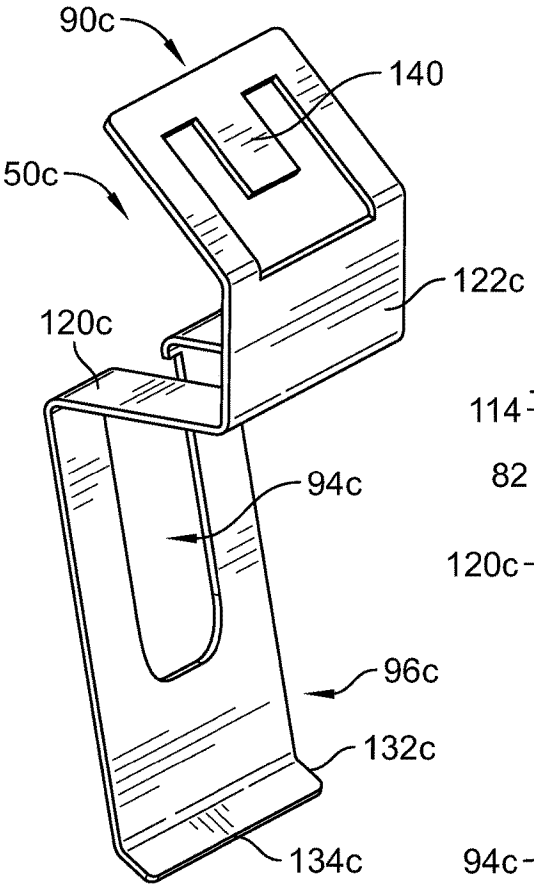

Finally, the adapter configuration 50*c* shown in FIGS. 23-25 is similar to all of the adapters 50, 50*a*, 50*b*, and 50*d* the corresponding descriptions generally apply to this configuration, as well, but the adapter 50*c* also provides a universal configuration that can be used with both the forked-style handle 74 faucet 60 shown in FIG. 5 as well as the tap-style handle 76 faucet 62 as shown in FIG. 6. In this regard, a tang 140 extends from the engaging portion 90*c* to fit in an opening defined by the arms 80, 82 and below the cross member 84 of the forked-style handle 74. The tang 140 is also used to engage the backside of the vertically extending tap-style handle 76 shown in FIG. 6. As engaged by the adapter 50*c*, the same push-style operation can be accomplished was with the other adapter configurations 50, 50*a*, 50*b*.

Figure 26:
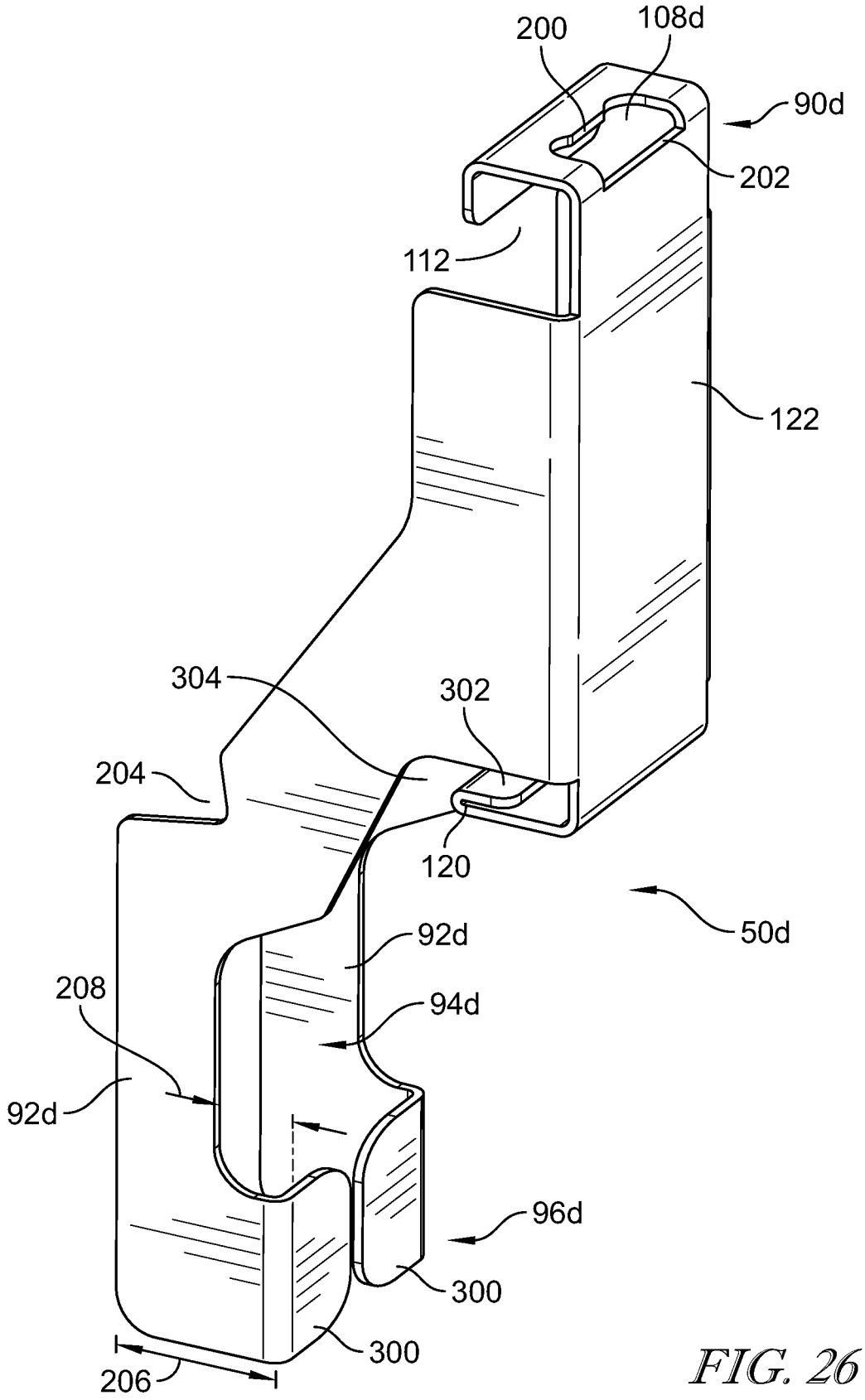
FIG. 26 shows an enlarged adaptor 50*d* for attachment to a faucet of a beverage-dispensing device showing a body portion from which extends a handle engaging portion, a fulcrum portion, at least one extending portion and a cup engaging portion, with a nozzle clearance area being defined relative to the fulcrum, extending portion, and cup engaging portion, a notch is provided in the at least one extending portion for providing additional clearance around a faucet structure, the cup engaging portion is adjusted relative to other embodiments to provide more handle travel when pivoting relative to operation, and a top opening is provided with enhanced features to engage different faucet handle configurations.

As shown in FIG. 26, another embodiment of the adaptor 50*d* is provided generally configured in a similar manner as the embodiments shown in FIGS. 1-4 and 7-12. In this regard, the adaptor 50*d* has the general overall configuration as the adaptor 50 but has an additional enhancements relative to various features. In this regard, the adaptor 50*d* includes the body 122, handle-engaging portion 90*d*, the stiffening portions 92*d*, 92*d* and the cup engaging portion 96*d*. The nozzle clearance area 94*d* is provided as defined by the extending portions 92*d*, the fulcrum portion 122, and the cup engaging portion 96*d*.

Figure 2:
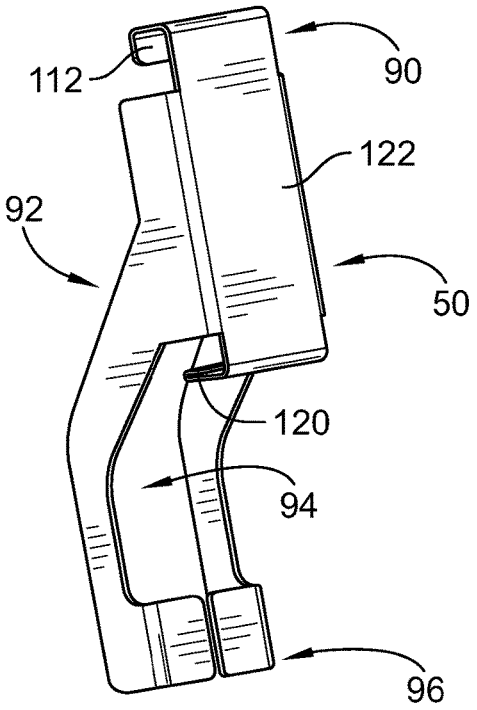
FIG. 2 is an enlarged illustration of the adapter removed from the beverage dispenser showing, in front perspective view, a handle engaging portion, at least one stiffening portion, a nozzle clearance area, and a cup engaging portion.
Figure 3:
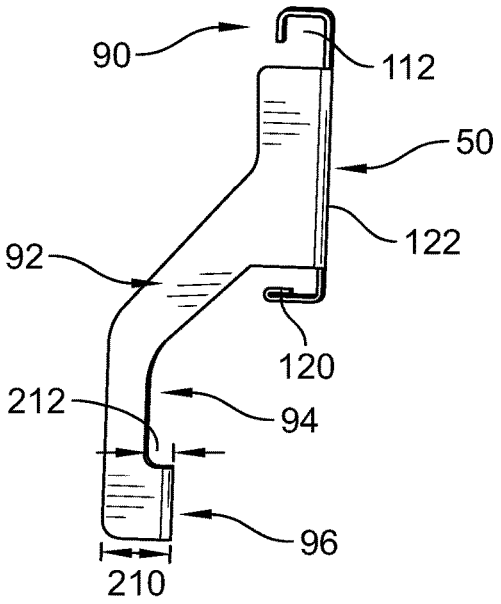
FIG. 3 is a left side elevational view of the adapter showing the relationship between the handle engaging portion, stiffening portion, nozzle clearance area, and cup engaging portion of this embodiment.
Figure 4:
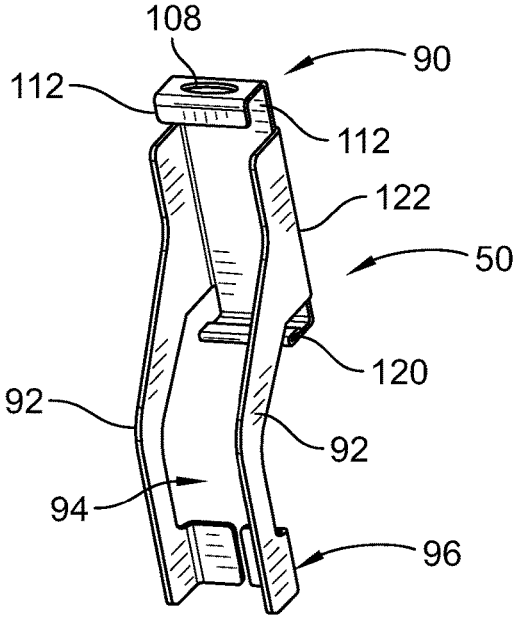
FIG. 4 is a rear perspective view of the adapter as shown in FIGS. 1-3 showing a fulcrum portion extending between the handle engaging portion and the stiffening portions for engagement against a portion of the nozzle to provide leverage when operating the adapter to controllably operate the faucet, and an opening formed in the handle engaging portion for receipt of a portion of a handle of the faucet as well as top opening to engage portion of a handle of the faucet as well as side openings to accommodate portions of a different handle configuration.

The difference between the adaptor 50*d* in FIG. 26 and the adaptor 50 in FIG. 2 is that there are several features that are enhancements which apply to various applications such as with specific faucet types or operating preferences. In this regard, the handle-engaging portion 90*d* includes the top opening 108*d* to receive and engage a tip or crown 110 of a tap-style handle 76. The enhancement in the opening 108*d* is that there is an internal protrusion 200 and a cutout area 202. In comparison to the embodiment shown in FIG. 2, the top opening 108 is formed in a planer surface of the handle-engaging portion 90. In contrast, the opening 108*d* in FIG. 26 includes the protruding portion 200 and the cutout area 202. This helps to accommodate different handle configurations to help in the application of the adaptor 50*a* to a particular faucet and/or handle configuration as well as to help retain and/or capture the portion of the handle extending through the opening 108*d*.

FIG. 26 also includes a notch 204 formed in each of the extending portions 92*d*. The notch 204 provides additional clearance around an upper shoulder 136 of the faucet 62. This upper shoulder 136 can be in the form of a nut which is used as a cover to the nozzle 68 to retain components within the faucet 60, 62. This prevents the adaptor 50*d* which allows the structure to be positioned around the shoulder/nut 136 without causing interference.

The embodiment as shown in FIG. 26 also provides a cup-engaging portion 96*d* which is translated forward 206 relatively to the overall alignment of the adaptor 50*d* to help enhance the travel of the handle attached to the adaptor. In this regard, the geometry of the adaptor 50*d* has a greater forward dimension 208 of the cup-engaging portion 96*d* relative to the extending portion 92*d*. This results in a geometry that increases the pivot range of the adaptor 50*d* relative to the nozzle and the handle associated with the nozzle. The dimensional difference between the dimensions identified herein 206, 208 can be seen in comparison on the corresponding portion of the embodiment shown in FIGS. 1-4, namely FIG. 3 which shows these corresponding dimensions as 210, 212. While 210 and 206 may be relatively similar, the relationship of 208 and 212 shows that the dimension 208 is relatively greater and adjusted more forwardly from the corresponding extending portion 92*d* than the similar dimension 212 shown in FIG. 3.

The configurations of the embodiments in FIGS. 1-26 are designed to be fabricated of a material which originates in a generally planar form. Such material could be in the form of metal such as stainless steel, plastic, or other materials such as multi-layer materials and composites. This discussion regarding the fabrication of the configurations is not intended to be limited by the materials but is provided as one example of the use of such materials to fabricate these embodiments. As described within the specification, these embodiments have structures that provide functions to allow the attachment of the adapter 50, 50*d* to a faucet of 60, 62 of a beverage dispenser 30. It should be noted that the adapter could be formed as a single piece component through suitable applications of metal casting, plastic injection, plastic vacuum forming or other manufacturing processes. However as described herein the configurations of the embodiments can be formed generally of a planar piece of material that is deformed to achieve the various shapes as shown in the figures.

In this regard, a blank can be stamped from a continuous piece of material having all of the various features as shown in the embodiments (FIGS. 1-26) which are then fabricated either manually or automatically to achieve the design as shown herein. Fabrication is achieve through controlled forming and or bending in a die, jig, form, or on a brake. As an example, starting with the flat planar blank, as shown in FIG. 26, tabs 300 in the cup engaging portion 96*d* are folded relative to the corresponding surface of the extending portions 92*d*, 92*d*. The faucet engaging portion 90*d* is also formed by bending the angles shown in FIG. 26 to achieve the illustrate configuration. It should be noted that the opening 108*d* and any other corresponding openings and other features are formed during the stamping process to provide blank used to form the end result as shown in the figures. Next, the fulcrum area can also be deformed as shown by folding to produce a reinforced structure having a double fold 302 at the one edge 304. After these structures have been deformed as shown, the extending portions 92*d*, 92*d* can then bent relative to the body 122 at generally right angles. While right angles are mentioned, these are generally radiused right angles.

It should be noted that the specific steps defined herein do not limit the fabrication of the adapters 50-50*d* but are provided by way of explanation to describe how a flat blank stamped from a continuous piece of material can be formed to achieve the claimed design. The bending of the material during the fabrication process can provide additional strength such as by way of the stiffening portions 92*d*, 92*d*. Similarly, the double fold 302 at the edge 304 of the fulcrum portion 122 provides additional strength and durability at the fulcrum area which carries a significant portion of the load of the operation of the adapter 50, 50*d* as it is pivoted by a user pressing a cup 100 in the cup engaging portion 96*d* and transferring forces upwardly through the stiffening portions 92*d*, 92*d* to the handle engaging portion 90*d*.

All of the adapters 50, 50*a*, 50*b*, 50*c*, 50*d* are configured for attachment to a faucet assembly already installed on the beverage dispensing device. In this regard, the owner/operator of the restaurant or other facility that owns the dispensing device 30 can attach these adapters relatively quickly, easily, and without tools, fasteners, adhesives, and the like. In this regard, typically the adapter is positioned at somewhat of an angle or in an appropriate manner to position the faucet engaging portion 90 relative to and positioned for engagement with the corresponding portion of the faucet handle whereby the nozzle clearance area 94 is positioned over the nozzle body to prevent contacting the nozzle. In this regard, the adapter is retained on the faucet for controlled push operation use of the faucet to reduce contact by users operating the faucet and to reduce the potential for transfer of substances, germs, and other materials that might be found on the user's hands or on the rim of a previously used cup.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A faucet operating adapter for use with a beverage dispensing device having a controllable dispensing faucet, the adapter being positionable over the controllable dispensing faucet and engageable with an upper portion of a handle of the controllable dispensing faucet to eliminate the need to use a hand to touch the handle to actuate the controllable dispensing faucet, the adapter comprising:

a body portion;

a handle engaging portion at one end of the body portion, the handle engaging portion physically engaging with the upper portion of the handle to facilitate operation of the handle to operate the controllable dispensing faucet;

a fulcrum portion extending from the body portion spaced from the handle engaging portion;

at least one stiffening portion extending from the body portion at an area between the handle engaging portion and the fulcrum portion and extending downwardly from the body portion below the fulcrum portion;

a cup engaging portion on the stiffening portion spaced from the fulcrum portion; and a clearance area between the cup engaging portion and the fulcrum portion.

2. An adapter for removable attachment to a faucet, the adapter being positionable over the faucet and engageable with an upper portion of a handle of the faucet to eliminate the need to use a hand to touch the handle to actuate the faucet, the adapter comprising:

a body portion;

a handle engaging portion on the body portion for physically engaging the handle of the faucet to facilitate operation of the handle to operate the faucet;

a cup engaging portion spaced from the handle engaging portion;

at least one extending portion extending from the body portion, the extending portion spacing the cup engaging portion from the handle engaging portion;

a fulcrum portion positioned between the handle engaging portion and the cup engaging portion;

the fulcrum portion abutting an outside surface of the faucet to provide a pivot point for operation of the faucet by use of the adapter; and wherein the user grips a cup and presses the cup against the cup engaging portion to apply a force to the adapter to operate the faucet engaged with the adapter without using their hand to touch the handle of the faucet to operate the faucet.

3. The adapter of claim 2, the adapter being attachable to and removable from the faucet without the use of one or more of tools, fasteners, and adhesives.

4. A faucet operating adapter, the adapter being positionable over the faucet and engageable with an upper portion of a handle of the faucet to eliminate the need to use a hand to touch the handle to actuate the faucet, the adapter being formed from a generally planar material, the fabrication of the adapter including the steps comprising:

providing a blank of material from a generally planar material, the blank of material having all of the elements of the adapter once fabricated into the final configuration of the adapter;

retaining the blank and bending structures relative to a body portion to fabricate structures associated with the adapter;

providing an opening at one end of the adapter through a surface of the adapter to provide a handle engaging opening to engage the upper portion of the handle;

providing at least one extending portion extending from the body portion;

bending portions of the blank proximate the upper portion of the body to form a handle engaging portion;

bending a portion of the blank spaced away from the handle engaging portion to form a fulcrum portion;

bending at least one tab positioned at the end of an extending portion;

bending at least one extending portion including a tab to form a stiffened extending portion relative to the body portion;

releasing the fabricated blank as formed to provide the adapter; and wherein the user grips a cup and presses the cup against the a portion of the adapter to apply a force to the adapter to operate the faucet engaged with the adapter without using their hand to touch the handle of the faucet to operate the faucet.

5. A method of using a faucet operating adapter with a faucet having a handle and a valve in a biased, normally closed position, the adapter being positionable over the faucet and engageable with an upper portion of the handle of the faucet to eliminate the need to use a hand to touch the handle to actuate the valve from the normally closed position to an open position, the method comprising the steps of:

providing an adapter having a body portion, providing a handle engaging portion extending from the body portion;

providing a cup engaging portion spaced from the handle engaging portion, providing a fulcrum portion spaced between the handle engaging portion and the cup engaging portion;

positioning the handle engaging portion relative to an upper portion of the handle of the faucet;

positioning the fulcrum portion against an outside surface of the faucet; and wherein the user grips a cup and presses the cup against the cup engaging portion of the adapter to apply a force to the adapter to operate the faucet engaged with the adapter without using their hand to touch the handle of the faucet to operate the faucet.

* * * * *